US005209491A

United States Patent [19]

Dodge

[11] Patent Number: 5,209,491

[45] Date of Patent: May 11, 1993

[54] TARGET APPARATUS

[75] Inventor: Meldon A. Dodge, Oswego, N.Y.

[73] Assignee: Top Dart Systems, Inc., Rochester, N.Y.

[21] Appl. No.: 859,944

[22] Filed: Mar. 30, 1992

[51] Int. Cl.[5] ..... F41J 5/04

[52] U.S. Cl. ..... 273/371

[58] Field of Search ..... 273/371, 373, 374, 376

[56] References Cited

U.S. PATENT DOCUMENTS 2,629,599 2/1953 Gaut ..... 273/373

4,244,583 1/1981 Wood et al. ..... 273/373

4,678,194 7/1987 Bowyer et al. ..... 273/373

*Primary Examiner*—Benjamin H. Layno

*Attorney, Agent, or Firm*—Frank Pincelli

[57] ABSTRACT

A target and target apparatus wherein projectiles may be embedded in the target. The target including a target face which is divided into a plurality of beds. The beds are conductive at least on the outer surfaces and are insulated from adjacent beds by an insulating web. The beds are electrically connected to an apparatus source to enable a separate signal to be applied to each bed. An aerial is provided to respond to a signal from a dart protruding from any bed. The aerial comprising a wire framework mounted on the target face and is in superimposed alignment with the web. Ties are provided for securing the wire framework to the insulating web such that the wire framework remains in superimposed alignment with the web.

22 Claims, 3 Drawing Sheets

TARGET APPARATUS

BACKGROUND OF THE INVENTION

The present invention relates to a target apparatus, and more particularly, to a target apparatus which incorporates a target of the type in which a projectile may be embedded, with part of the projectile still protruding from the target. For example, in this specification, the invention will be described with prime reference to a dartboard, but is to be understood that the invention may be applied to other similar targets, such as an archery target, if appropriate modifications are provided.

It is known from U.S. Pat. No. 4,678,194 to provide a target apparatus which provides for the automatic scoring of a dartboard game. In particular, this patent teaches the use of dividing a target into a plurality of beds each comprised of substantially parallel fibers that are or have been treated to be conductive, at least on the outer surface, the beds being insulated from adjacent beds. The beds are designed to receive a projectile, such as a dart, which when embedded in a particular bed will provide a signal indicative of the portion of the target struck. The beds are typically separated by an insulating plastic web structure which divides the target into a plurality of target areas. A wire framework is placed directly above the web structure which functions as an antenna. The wire framework is insulated from the beds and is held in position by a plurality of plastic tie members.

In order for the target device to properly operate and maintain correct scoring, it is very important that the beds maintain their insulated properties from each other and from the aerial framework placed on the target face. A serious problem experienced with prior art devices is the ability of the device to maintain these insulating properties. Due to repeated hitting of the target by metal tipped darts, the insulating material separating the beds often become damaged. This results in the adjacent beds touching and the incorrect operation of the device. Additionally, the steel tip darts have been found to break the insulating plastic ties used to secure the wire framework in position. This results in movement of the antenna and again affects the correct operation of the device.

Applicants have invented an improved target and target apparatus wherein the target is able to withstand repeated embedding of steel tip darts while maintaining the insulating integrity between the beds and/or aerial framework.

SUMMARY OF THE INVENTION

A target and target apparatus wherein projectiles may be embedded in the target. The target comprises a target face, which is divided into a plurality of beds. The beds are conductive at least on the outer surfaces and insulated from adjacent beds by an insulating web. Conductive means are provided connected to each of the beds to enable a separate signal to be applied to each bed. Aerial means are provided to respond to a signal from a dart protruding from any bed. The aerial means comprising a wire framework mounted on the target face which is in superimposed alignment with the web. Means are provided for securing the wire framework to the insulating web such that the wire framework remains in its superimposed alignment with the web.

DETAILED DESCRIPTION OF THE PREFERRED EMBODIMENT

Figure 1:
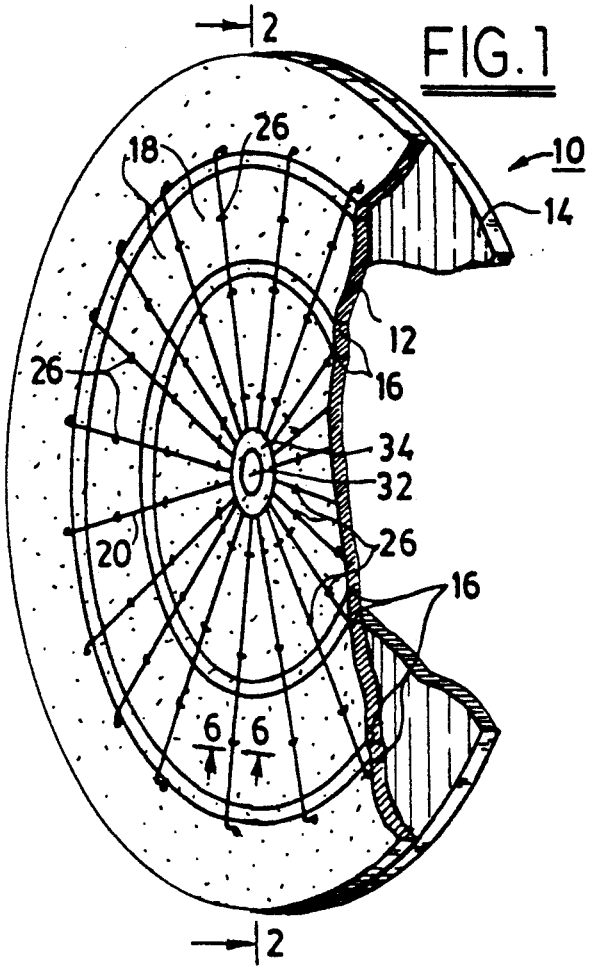
FIG. 1 is a perspective of target, partially broken away, made in accordance with the present invention.
Figure 2:
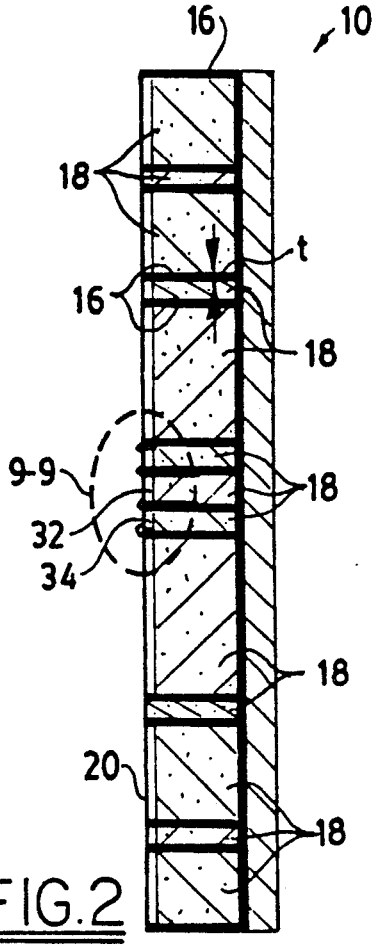
FIG. 2 is a cross sectional view of the target of FIG. 1 taken along line 2—2.
Figure 3:
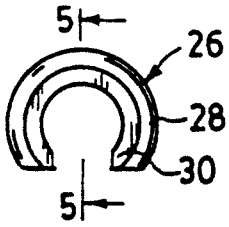
FIG. 3 is a greatly enlarged front elevational view of a tie used to secure the wire framework to the insulating web.
Figure 4:
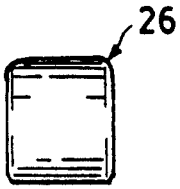
FIG. 4 is a side elevational view of the tie of FIG. 3.
Figure 5:
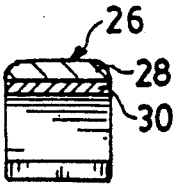
FIG. 5 is a cross sectional view of the tie of FIG. 3 taken along line 5—5.
Figure 6:
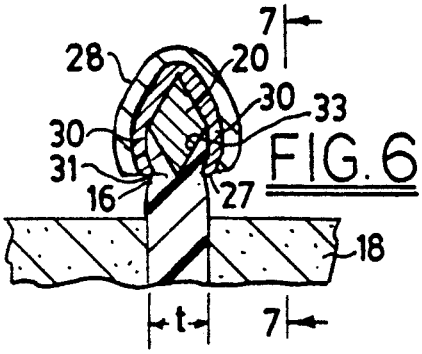
FIG. 6 is a greatly enlarged view of the target of FIG. 1 as taken along line 6—6 of FIG. 1.
Figure 7:
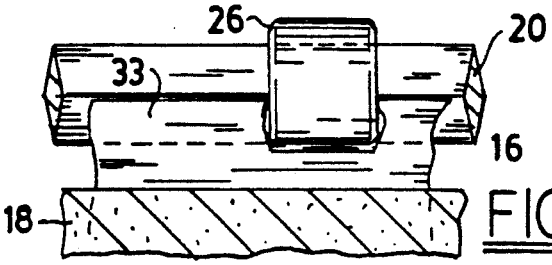
FIG. 7 is a side elevational view of the wire framework of FIG. 6 taken along line 7—7.

Referring to the FIGS. 1-7, 9 and 10, there is illustrated a target 10 made in accordance with the present invention. Target 10 is designed to be used with an automatic target apparatus of the type disclosed in U.S. Pat. No. 4,678,194, which is hereby incorporated by reference. In the present invention the target 10 is a dartboard and consists of a plurality of conductive fibers 12 which extend forwardly from a backing member 14. The conductive fibers are separated into a plurality of adjacent beds by an insulating web 16. The dartboard 10 of this type may be fabricated by substantially conventional techniques utilizing conductive fibers. The fibers may be sisal fibers that have been coated with a waterproof material and subsequently coated with a conductive material, for example, by immersing (or spraying with) or a suspension of graphic particles as sold under the trademark "ELECTRODADG". The fibers are compressed while substantially parallel and are cut to have a planar end face. This is bonded to an appropriate backing sheet which may be a temporary backing sheet having an aperture or perforated portions corresponding to the shape of web 16. The fibers are then cut again so that a plurality of short parallel fibre lengths remain bonded to the backing sheet. A hole is then cut in the assembly thus producing a shape corresponding to that of the web 16. The hole may be cut through the aperture or perforated portions of the backing sheet. The web 16 is then pressed into the hole to form separate beds 18 into the target. The assembly then, if desired, can be bonded to a rigid permanent backing sheet. Electric contacts are made with the electrical conducting core of the web and with various conducting elements on the laterally facing parts of the web 16. This provides a separate electrical contact with each of the discrete beds and fibers. Connective means are provided and connected to each of the beds to make separate signals to be applied in each bed as is more thoroughly discussed in the '194 patent previously referred to and which has been incorporated by reference herein.

Aerial means are provided to respond to a signal radiated from a dart protruding from any bed. In the particular embodiment illustrated the aerial means comprises a wire framework 20 mounted on the target 10. The wire framework 20 is insulated from the beds 18. In the particular embodiment illustrated, the ends 21 of the framework 20 pass through the bed and are each surrounded by a cylindrical insulating sleeve 24 which electrically insulates the wire framework 20 from the beds 18. The ends 21 of the framework 20 are connected in an appropriate manner to the electronics as is more fully described in the '194 patent.

In the particular embodiment illustrated the insulating web comprises an insulating plastic material having a cross-sectional thickness of about 1/32 of an inch (0.0793 cms). A plurality of ties 26 are provided between the ends of the framework 20 to maintain in position the wire framework 20 in superimposed alignment above web 16. The ties comprise an outer protective layer 28 and an inner insulating layer 30. The outer layer 25 is preferably made of durable metal which is designed to withstand repeated hitting by a steel tip dart without breaking. In the embodiment illustrated layer 28 is made of brass and has a thickness of about 0.010 inches (0.254 cms). The inner layer 30 insulates the wire from the adjacent beds. The ties 26 are simply crimped in position by an appropriate tool. Preferably the web 16 is made of a plastic material such that when heated and the tie 26 is crimped over the wire framework 20, the ends 27 of the ties 26 firmly captures the upper end 31 of the web 16. Preferably the upper end 31 of the web 16 is heated to a temperature so as to soften web 16 such that when tie 26 is crimped thereon, it will cause the web to deform in accordance to the shape of end of tie 26 and serve to securely affix tie 26 to web 16. Applicants have found that this heating may be accomplished by a heating iron held adjacent the web 16, however, the web may be heated in any desired manner.

In the particular embodiment illustrated (see FIG. 6) the wire from which wire framework 20 is made has a substantially diamond-shaped cross-sectional configuration, with the point of the diamond facing toward the player. This shape and orientation of the wire assists in deflecting any dart that may be thrown at the target and thereby avoids or minimizes damage to the web underneath. However, it is to be understood that the cross sectional configuration of the wire framework 20 can take any shape so desired. Preferably, as illustrated, the top edge 33 of web 16 has a configuration designed to mate and receive wire framework 20 so as to further assist in maintaining wire framework 20 directly above web 16. It is of course understood that the wire framework 20 may take any other desired cross sectional shape. The framework 20 may be further secured to web 16 the application of an appropriate adhesive therebetween.

Figure 8:
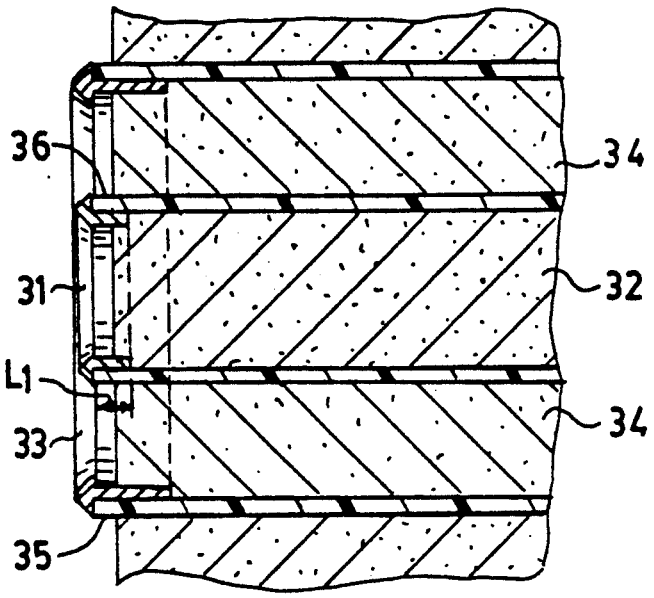
FIG. 8 PRIOR ART
FIG. 8 is a greatly enlarged cross sectional view of the center portion of a target made in accordance with the prior art.

Referring to FIG. 8, there is illustrated a target made in accordance with the prior art. In the center area of the target there is typically provided an inner circular bed 32 and a second outer concentric target bed 34. These two beds 32, 34 are insulated from each other and from the other adjacent beds for the same reason previously discussed. Adjacent each beds 32, 34 there is provided protecting rings 31, 33, respectively. It has been found that these protecting rings 31, 33 are insufficient in size and strength in protecting the adjacent insulating rings 35, 36 from damage due to repeated hitting by the steel tip of darts. Ring 31 extends into the adjacent bed only a short distance $L_1$ of about 1/16 of an inch (0.0625 cms). Applicants have found that the insulating rings 35, 36 must be better protected if durability of the target is to be increased to acceptable commercial levels.

Figure 9:
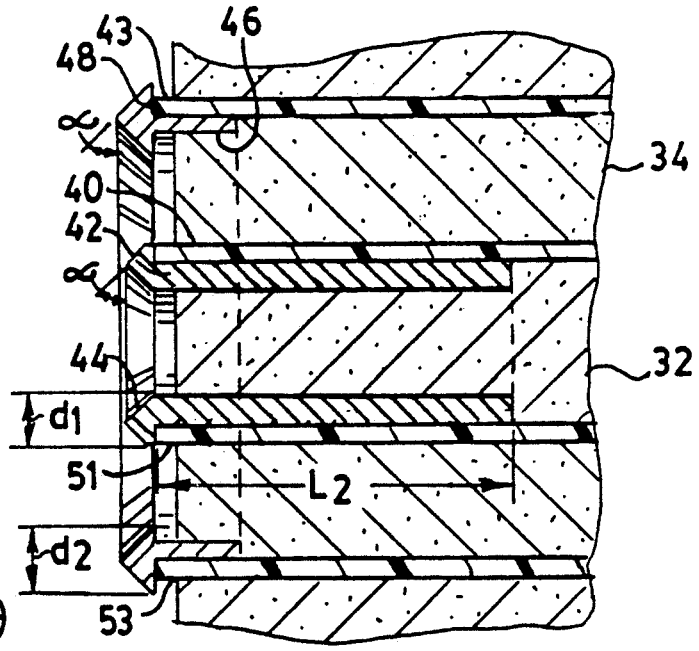
FIG. 9 is a greatly enlarged cross sectional view of the center of the target of FIG. 1 as shown by line 9—9.
Figure 10:
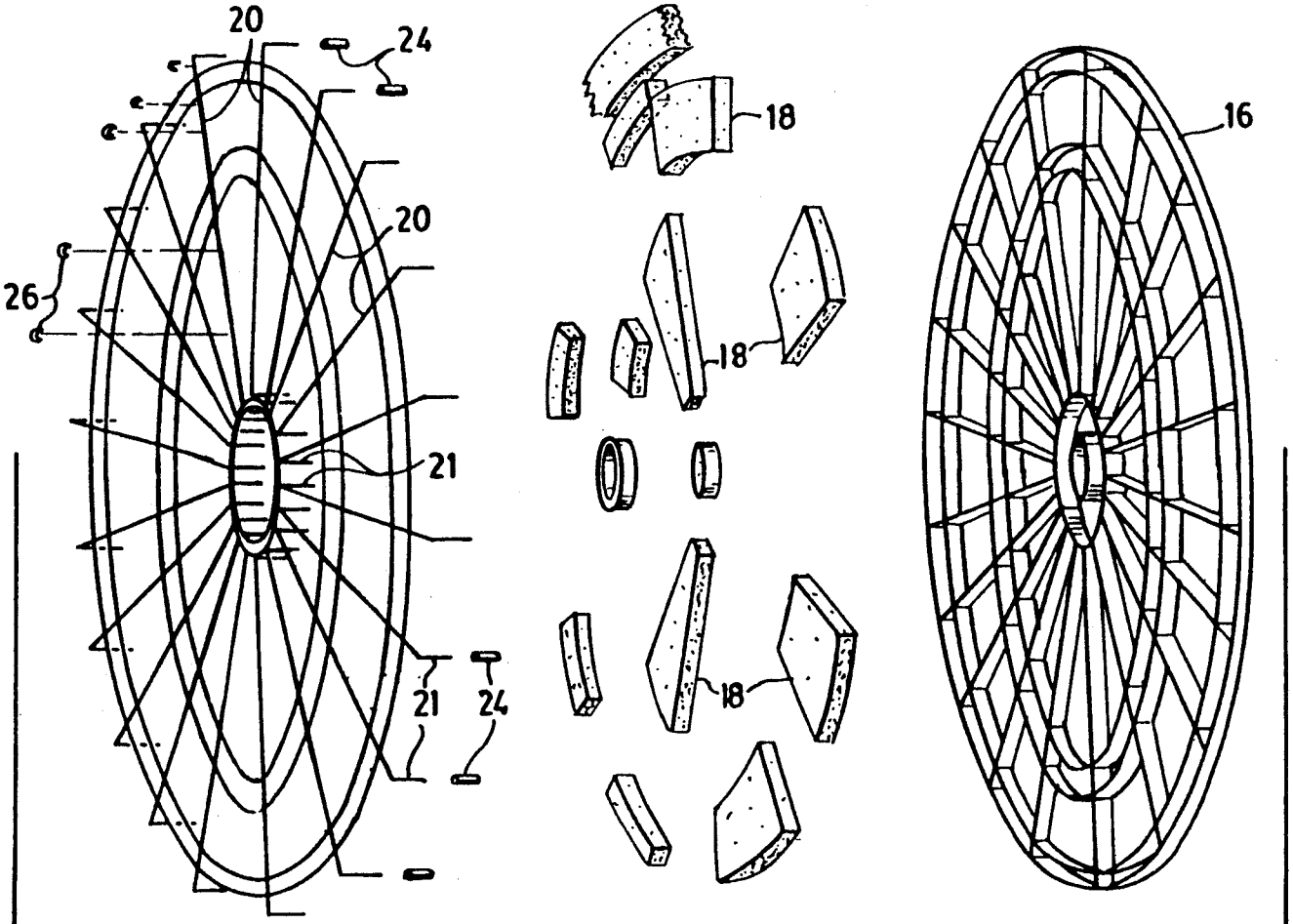
FIG. 10 is an exploded view of the target of FIG. 1.

Referring to FIG. 9, there is illustrated the center portion of target 10 made in accordance with the present invention. In particular, an insulating ring 40 is provided for insulating the inner circular bed 32 from outer concentric bed 34 and an inner protective ring 42 is provided adjacent insulating ring 40 for protection of insulating ring 40. In a similar manner, an outer insulating ring 43 is provided for insulating the outer target section 34 from the remaining beds. An outer protective ring 46 is provided adjacent insulating ring 43 to minimize damage to ring 43. The inner and outer protective rings 42, 46 each have an upper end having a configuration designed to protect the adjacent upper end 51, 53 of the insulating rings 40, 43 respectively. In particular, the upper end of the rings 42, 46 have projecting portions 44, 48, respectively, which preferably overlie the adjacent insulating ring. The projecting portion 48 of ring 46 preferably extends past the edge of the insulating ring 43. The outer surface of the inner and outer rings 42, 46 is designed so as to deflect the tip of a dart thrown at the target. In the particular embodiment illustrated the outer surface has a generally arrow-shaped configuration with the point pointing toward the thrower. The outer surfaces of each of the rings 42, 46 preferably form an angle $\alpha$ of about 45° with respect to a plane perpendicular to the target surface. The inner ring 42 has a length $L_2$ which extends into the adjacent bed of about ¾ of an inch (1.905 cms). It is believed that this provides stability to ring 43 so as to maintain it in position on the target so it can protect the adjacent insulating ring. Applicant has found that the rings 42, 46 should be durable and resistant to repeated hitting by steel tip darts. Preferably the rings 42, 46 are made of a hard steel. In the particular embodiment illustrated rings 42, 46 are made of a cold rolled steel and are case hardened.

In the particular embodiment illustrated an approximate three ties are provided between the ends 21 of wire framework 20. It is to be understood that any desired number may be provided. One of the important aspects of the present invention is that the ties are provided with a hard, durable outer surface which is resistant to the tip of a dart that is thrown at the target such that the wire framework maintains its superimposed alignment above the web.

It can be seen from the foregoing that the insulating web separating the adjacent beds is protected by the wire framework and protective inner rings. In this manner the insulating integrity between the beds is maintained. Additionally, the movement of the wire framework on the surface is substantially eliminated as the wire framework is held firmly in position due to the ties that are provided thereon.

As previously noted, it is extremely important that the wire framework be secured to the top of web 16 so as to minimize change to the web. Preferably the wire framework 20 is all one level, i.e., lies in single plane, and is bonded directly to the top of web 16. In the embodiment illustrated the wire framework is made of wire bent into the desired configuration. However, wire framework 20 may be molded, punched out of a metallic sheet or otherwise fabricated.

It is to be understood that the various changes and modifications may be made without departing from the scope of the present invention.

I claim:

1. A target in which projectiles may be embedded, said target including a target face, said target face being divided into a plurality of beds, the beds being conductive at least on the outer surfaces and being insulated from adjacent beds by an insulating web, conductive means are provided connected to each of said beds to enable a separate signal to be applied to each bed, aerial means are provided to respond to a signal from a dart protruding from any bed, said aerial means comprising a wire framework mounted on said target face and being in superimposed alignment with said web, means are provided for securing said wire framework to said insulating web such that said wire framework remains in superimposed alignment with said web, said means for securing said wire framework to the web being resistant against breakage due to repeated hitting by metal tipped darts.

2. A target according to claim 1 wherein said means for securing said wire framework to said insulating web comprises at least one insulating tie having an outer protective surface for protection against breakage due to being hit repetitively by the point of a dart and an insulating inner surface for surrounding a portion of wire framework.

3. A target according to claim 2 wherein said insulating tie has an outer metal layer and an inner non-conductive layer.

4. A target according to claim 1 wherein said wire framework is made of a wire having a substantially diamond shaped cross sectional configuration.

5. A target according to claim 1 wherein said plurality of beds includes a first inner bed having a substantially circular configuration and a second outer substantially concentric circular bed surrounding said first inner bed, said first and second beds being separated from each other and from the other beds by a first and second circular insulating means respectively, a first protective member is provided adjacent said first circular insulating means and having a configuration for protecting the upper end of said first insulating means and a second protective means placed adjacent said second insulating means for protecting the outer surface of said second insulating means.

6. A target according to claim 5 wherein the outer engaging surface of at least one of said first or second protective ring member has a configuration such that a portion of the ring member is provided above the adjacent insulating ring so as to protect and deflect the tip of the dart thrown at that target face.

7. A target according to claim 1 wherein said web having a configuration at its upper end designed to mate and cradle said superimposed wire framework.

8. A target according to claim 7 wherein said wire framework is made from a wire having a substantially diamond shaped configuration and in position above said web such that one of the points is positioned in a direction toward the web.

9. A target according to claim 1 wherein a pair of concentrically spaced circular beds are provided in the central portion of the target, an insulating ring is provided adjacent each circular bed, a protective ring is disposed adjacent each circular bed and associated insulating ring, each of said protective rings having an upper end which extends above the adjacent insulating ring, the upper surface of at least one of the protective rings extending past the adjacent insulating ring.

10. A target according to claim 1 wherein said wire framework lies substantially in a single plane.

11. A target in which projectiles may be embedded, said target including a target face, the target face being divided into a plurality of beds, the beds being formed from substantially parallel fibers that are, or have been, treated to be conductive at least on the outer surfaces of said fibers adjacent the face of said target, said fibers in each bed extending substantially normal to the target face and being insulated from the fibers in the adjacent beds by a plastic insulating web, a backing means is provided for mounting said fibers substantially normal to said backing member, each of said fibers having a free end, where the free end of the fibers define said target face wherein conductive means are provided to each of said beds to enable a separate signal to be applied to each bed, aerial means are provided to respond to a signal radiated from a dart protruding from any bed, said aerial means comprising a wire framework mounted on the target face and lying directly above the insulating web, means are provided for securing said framework directly to said insulating web, said means for securing said wire framework to the web being resistant against breakage due to repeated hitting by metal tipped darts.

12. A target according to claim 11 wherein said means for securing said wire framework to said insulating web comprises at least one insulating tie having an outer protective surface for protection against breakage due to being hit repetitively by the point of a dart and an insulating inner layer which is adjacent said wire framework.

13. A target according to claim 11 wherein said insulating tie has an outer metal layer and an inner non-conductive layer.

14. A target according to claim 11 wherein said wire framework is made of a wire having a substantially diamond shaped cross section configuration.

15. A target according to claim 11 wherein said web having a configuration at its upper end designed to mate and cradle said superimposed wire framework.

16. A target according to claim 15 wherein said wire framework is made from a wire having a substantially diamond shaped configuration and in position above said web such that one of the points is positioned in a direction toward the web.

17. A target according to claim 11 wherein said plurality of beds includes a first inner bed having a substantially circular configuration and a second outer substantially circular bed surrounding said first inner bed, said first and second beds being insulated from each other by a first circular insulating ring, a first protective ring is provided adjacent said first insulating ring, said first protective ring member having a configuration so as to protect the first insulating ring, said second outer bed being separated from the remaining beds by a second circular insulating ring, a second protective ring is provided adjacent said second insulating member, said second circular protective ring having a configuration for protecting the outer surface of said second insulating ring.

18. A target according to claim 17 wherein the outer engaging surface of at least one of said first or second protective ring member has a configuration such that a portion of the ring member is provided above the adjacent insulating ring so as to protect and deflect the tip of the dart thrown at that target face.

19. A target apparatus including: a target in which projectiles may be embedded, said target including a target face, said target face being divided into a plurality of beds, the beds being conductive at least on the outer surfaces and being insulated from adjacent beds by an insulating web, conductive means are provided connected to each of said beds to enable a separate signal to be applied to each bed, aerial means are provided to respond to a signal from a dart protruding from any bed, said aerial means comprising a wire framework mounted on said target face and being in superimposed alignment with said web, and means for securing said wire framework to said insulating web such that said wire framework remains in superimposed alignment with said web, said means for securing said wire framework to the web being resistant against breakage due to repeated hitting by metal tipped darts, at least one transmitting/receiving projectile, said beds comprising means for passing electromagnetically transmitted signals between a bed and said at least one transmitting/receiving projectile embedded in said bed.

20. A method of making a target having target face, said target face being divided into a plurality of beds, the beds being conductive at least on the outer surfaces and being insulated from adjacent beds by an plastic insulating web, conductive means are provided connected to each of said beds to enable a separate signal to be applied to each bed, aerial means are provided to respond to a signal from a dart protruding from any bed, said aerial means comprising a wire framework mounted on said target face and being in superimposed alignment with said web, and a plurality of ties for securing said wire framework to said insulating web such that said wire framework remains in superimposed alignment with said web, comprising the steps of:

heating the web at the location at which said ties are to be secured to the web;

crimping the ties on said web so as to deform the web such that the tie will remain securely in place.

21. A target in which projectiles may be embedded, said target including a target face, said target face being divided into a plurality of beds, the beds being conductive at least on the outer surfaces and being insulated from adjacent beds by an insulating web, conductive means are provided connected to each of said beds to enable a separate signal to be applied to each bed, aerial means are provided to respond to a signal from a dart protruding from any bed, said aerial means comprising a wire framework mounted on said target face and being in superimposed alignment with said web, means are provided for securing said wire framework to said insulating web such that said wire framework remains in superimposed alignment with said web, said means having a hard durable metallic outer surface which is resistant to breakage due to repeated hitting by metal tipped darts.

22. A target in which projectiles may be embedded, said target including a target face, said target face being divided into a plurality of beds, the beds being conductive at least on the outer surfaces and being insulated from adjacent beds by an insulating web, conductive means are provided connected to each of said beds to enable a separate signal to be applied to each bed, aerial means are provided to respond to a signal from a dart protruding from any bed, said aerial means comprising a wire framework mounted on said target face and being in superimposed alignment with said web, means are provided for securing said wire framework to said insulating web such that said wire framework remains in superimposed alignment with said web, a pair of concentrically spaced circular beds are provided in the central portion of the target, an insulating ring is provided adjacent each circular bed, a protective ring is disposed adjacent each circular bed and associated insulating ring, each of said protective rings having an upper end which extends above the adjacent insulating ring, the upper surface of at least one of the protective rings extending past the adjacent insulating ring.

* * * * *

UNITED STATES PATENT AND TRADEMARK OFFICE

CERTIFICATE OF CORRECTION

PATENT NO. : 5,209,491

DATED : May 11, 1993

INVENTOR(S) : Meldon A. Dodge

It is certified that error appears in the above-indentified patent and that said Letters Patent is hereby corrected as shown below:

The following Claim 23, should be added: In Column 8:

23. A target apparatus according to claim 1 wherein said means for securing said wire framework to said insulating web comprises an adhesive disposed between the framework and the web.

Signed and Sealed this

Fourteenth Day of December, 1993

*Attest:*

Bruce Lehman

BRUCE LEHMAN

*Attesting Officer*

*Commissioner of Patents and Trademarks*